US006071852A

United States Patent [19]

Atkinson

[11] Patent Number: 6,071,852

[45] Date of Patent: Jun. 6, 2000

[54] PRESSURE-SENSITIVE RECORD MATERIALS

[75] Inventor: Victor G. Atkinson, Hollywood, United Kingdom

[73] Assignee: Carrs Paper Limited, United Kingdom

[21] Appl. No.: 09/046,459

[22] Filed: Mar. 23, 1998

Related U.S. Application Data

[63] Continuation-in-part of application No. 08/612,912, filed as application No. PCT/GB94/09192, Sep. 5, 1994, abandoned.

[51] Int. Cl.[7] ..... B41M 5/145

[52] U.S. Cl. ..... 503/213; 106/31.21; 106/31.22; 427/150; 427/151; 503/215; 503/218; 503/221

[58] Field of Search ..... 106/21 R, 31.16, 106/31.2, 31.21, 31.22; 427/150, 151; 428/402.2, 402.21, 402.22; 503/213, 215, 221, 218

[56] References Cited

FOREIGN PATENT DOCUMENTS 0 390 432 A3 3/1990 European Pat. Off. ..... 503/215

*Primary Examiner*—Bruce H. Hess
*Attorney, Agent, or Firm*—Fulbright & Jaworski L.L.P.

[57] ABSTRACT

An internal phase solution for a coating of rupturable material for application to a base sheet to form a pressure-sensitive record material comprises one or more color-formers of which at least 90% are monoamino and/or diamino fluoran derivatives dissolved in a solvent comprising 80% to 100% of one or more vegetable and/or animal oils. Preferably the color-formers comprise only monoamino and/or diamino fluoran derivatives and the solvent comprises only one or more vegetable and/or animal oils. Dissolution of the color-formers in the solvent may be place at a temperature in the range 100° C. to 135° C. and micro-capsules containing such color-former solution may be formed by conventional coacervation processes below 70° centigrade.

13 Claims, No Drawings

PRESSURE-SENSITIVE RECORD MATERIALS

This application is a CIP of Ser. No. 08/612,912 (May 1, 1996) now abandoned; which is a National Stage under 371 of PCT/6894/09192 (Sep. 5, 1994).

DESCRIPTION OF INVENTION

This invention relates to pressure-sensitive record materials of the kind comprising a base sheet, typically of paper, coated with a rupturable material confining droplets of a solution of colour-forming substances, which when released by rupture of the material undergo a colour-forming reaction to produce an image either on the base sheet itself or on a further, receptor sheet in face-to-face contact with the coated face of the base sheet.

In particular, but without limitation, the invention is applicable to so-called "carbon-less" copy papers which rely on two coatings formed respectively on the contiguous faces of superimposed sheets of paper, namely a coating containing the colour-forming substance in the micro-capsules, on the back of the uppermost sheet (usually known as a CB coating) and a coating of a receptor layer on the front of the lowermost sheet (usually known as a CF coating). Colour-forming chemicals are typically dissolved in an oily solvent and encapsulated by well known techniques, and when such capsules are ruptured by mechanical pressure, as by impact of a type bar of a typewriter, the chemicals are released and react to form a visible mark on the CF coating of the adjacent sheet.

Alternatively, the droplets may be dispersed thoughout a continuous phase coating of the rapturable material.

Conveniently, paper for use in such copying systems is of three types, distinguished by their coatings, namely CB sheets having a CB coating on the underside to form the top sheet of the set, CF sheets having a CF coating on the upper side to form the bottom sheet of a set, and optionally CFB sheets having a CF coating on the upper side and a CB coating on the underside to form one or more intermediate sheets of a set where required. Such coatings are normally applied by a continuous process to cover the entire area of the appropriate face of the sheet.

Conventionally colour-formers, e.g. various chromogenic materials, have normally been dissolved in a range of organic solvents, often aromatic solvents, which afford adequate solubility for such colour-formers and enable a good image to be produced.

Other proposals have been made with regard to the use of alternative solvents, which have environmental advantages, for the colour-formers, but so far no wholly acceptable alternative solvent has been found.

Whilst the use of animal or vegetable oils as solvents for colour-formers is suggested in the patent literature, it is generally acknowledged that they do give rise to solubility problems. For example, British Patent 1429578 includes various vegetable oils in a list of suitable solvents for conventional colour-formers and admits that some of the listed solvents have low solubility for the colour-formers, but they can be used because the invention requires different concentrations of colour-former solution at different positions within the coating so that the relatively poor solvents can be used for the more dilute colour-former solutions required by that invention.

U.S. Pat. No. 4,859,650 also proposes the use of plant, animal or parafin oils as solvents, and also admits that these are relatively poor solvents for conventional colour-formers, but proposes to overcome this difficulty by the use of a special type of triphenylmethane leuco-dye which is more soluble in such oils, preferably together with the addition of up to 20% of a conventional synthetic solvent. The use of such special leuco-dyes may be more costly than more conventional colour-formers and since the addition of synthetic solvents is required in practice to achieve an acceptable result, the full environmental advantages of natural solvents are muted.

Indeed many different systems of colour-formers and solvents have been proposed, including some which employ, at least in part, animal or vegetable oils as solvents. European Patent specification 0520639 A1 published Dec. 30, 1992 contains a lucid summary of such proposals which are directed to various improvements in the performance of the copy paper in various respects, but generally where the use of animal or vegetable oils as solvents is proposed either it is found necessary to use a synthetic oil as a co-solvent; or systems using animal or vegetable oils as solvents have been evaluated only as control examples to verify the superior performance of other solvent/colour-former systems, for example as in European Patent specification 0520639 itself.

Against this background, the present invention arises from a discovery that natural vegetable and animal oils can successfully be employed, without necessarily employing any conventional synthetic solvent, for a group of colour-formers in conventional micro-capsules, and more particularly that sufficiently concentrated solutions of this group of colour-formers in such vegetable or animal oils can be achieved to provide good imaging and good shelf-life characteristics.

In accordance with one aspect of the present invention we provide a composition, suitable for use as an internal phase of a coating of rupturable material on a base sheet to form a pressure-sensitive record material, the composition comprising one or more colour-formers of which at least 90% are monoamino and/or diamino fluoran derivatives, wherein the colour-formers are dissolved in a solvent consisting essentially of 100% of one or more vegetable and/or animal oils, alone or in combination, and selected from the group consisting of rape seed oil, cotton seed oil, olive oil, corn oil, wheat oil, soy oil, castor oil, thistle oil, ground nut oil, sunflower oil, grape seed oil, sesame oil, whale oil, sperm oil, fish oil and cod liver oil.

It has been found that whilst such oils do not afford sufficiently good solubility for most colour-formers in current use, they can be used for colour-formers based on amino fluorans.

However, to achieve the required solubility it may be necessary to perform the step of dissolving such colour-formers at a temperature above that normally employed, for example in the rage 100° C. to 135° C. and in accordance with another aspect of the invention we provide a method of manufacturing a pressure-sensitive record material of the kind comprising a base sheet coated with one or more colour-formers characterised in that at least 90% of said colour formers are monoamino and/or diamino fluoran derivatives, and said colour-formers are dissolved in a solvent comprising 80% to 100% of an animal or vegetable oil, dissolution of said colour-formers being carried out at a temperature above 100° C., and typically at up to 135° C.

One such a solution has been formed at such an elevated temperature, it can subsequently be cooled and processed in generally conventional manner to form the required rupturable coating to provide a product which has a good shelf life and good image forming properties in a manner which could not be achieved by dissolving other colour-forming substances, such as triphenylmethane leuco-dye stuffs, in the same solvents at the temperatures, generally below 100° C., normally employed.

In this way, we have found it possible to use a solvent which is up to 100% animal and/or vegetable oil.

The oils which may be used include rape seed oil, cotton seed oil, olive oil, corn oil, wheat oil, soy oil, castor oil, thistle oil, ground nut oil, sunflower oil, grape seed oil, coconut oil, sesame oil, whale oil, sperm oil, fish oil, cod-liver oil or any mixtures of one or more of these.

The colour-forming substances which may be employed in accordance with the invention include chromogenic materials such as particularly, but not exclusively, (A) 2'-(octylamino)6'-(diethylamino)fluoran, (B) 6'-(diethylamino)-2-(1,1-diethylethyl)fluoran, (C) 6'-(dibutylamino)-3'-methyl-2-(phenylamino)-spiro [isobenzofuran-1(3H),9-[9H]xanthen]-3-one, (D) spiro-[isobenzofuran-1(3H),9-(9H)xanthen]-3-one2'-[bis(phenylmethyl)amino]-6'-(diethylamino), (E) spiro-[isobenzofuran-1(3H),9-(9H)xanthen]-3-one,2'-carboxylic acid, 6'-diethylamino)-3-oxo-, ethyl ester, (F) 6'-diethylamino-2'-[2,4-dimethylphenyl)amino]-3'-methyl-spiro[isobenzofuran-1(3H),9-(9H)xanthen]-3-one, (G) 6'-(ethyl-(3-methylbutyl)amino-2'-phenylamino-3'-methyl-spiro[isobenzofuran-1(3H),9'-(9H)xanthen]-3-one, which are fluoran derivatives, as distinct from triphenylmethane leuco-dye stuffs.

One or more such chromogenic materials can be totally dissolved in a solvent consisting of up to 100% vegetable and/or animal oils to provide an internal phase for use in pressure-sensitive copying systems. It will however be understood that the solution may contain other additives to modify the characteristics or performance of the copying systems.

According to a further aspect of the invention we provide a pressure-sensitive record material comprising a base sheet coated with a rupturable material confining droplets of an internal phase comprising a solution made in accordance with the above-specified method.

In accordance with a still further aspect of the invention we provide a method of forming micro-capsules containing a solution of colour-formers in an organic solvent by coacervation, characterised in that at least 90% of said colour-formers comprise monoamino and/or diamino fluoran derivatives, dissolved at a temperature in excess of 100° C. in a solvent comprising 80% to 100% of one or more vegetable and/or animal oils to form an internal phase solution which is subsequently subject to coacervation at a temperature below 70° C.

Apart from the preparation and composition of the internal phase or core material, the micro-capsules in accordance with the invention and used for the pressure-sensitive copying paper are prepared by conventional methods and as such do not require an in depth description.

Using as internal phase the solution of chromogenic materials dissolved in animal and/or vegetable oil, micro-capsules can be prepared by the coacervation of gelatine and one or more other polymers such as carboxymethyl cellulose, gum arabic etc. in conventional manner.

The micro-capsules produced may be blended with other additives including a binder, such as starch or polyvinyl alcohol or a mixture of both, and undissolved buffer or "stilt" material such as calibrated wheat starch or finely ground cellulose floc (or a mixture of both) to prevent premature rupture of the coating composition during processing and subsequent handling.

The above coating composition may be applied to a range of paper substrates (40–15 g/m$^2$) by use of standard coating techniques designed to apply a closely monitored wet film weight e.g. air knife, offset gravure, metering roll.

In order to effect total dissolution of the chromogenic materials at the required concentration it is necessary to raise the temperature of the animal and/or vegetable oils to temperatures well above those required for conventional internal phase solvents such as alkylated naphthalene, chlorinated paraffins and hydrogenated terphenyls.

Experiment has shown that in order to affect total dissolution of the chromogenic materials it is necessary to raise the temperature of the oil to 100° C.–135° C. as compared with the temperatures required for conventional internal phase solvents which are generally below 100° C.

The invention is illustrated by the following non-limiting specific examples. All formulations are expressed by weight unless otherwise stated, and the specific colour formers employed in these examples are as follows:

A) 2'-(Octylamino)-6'-(diethylamino)fluoran:

(A)

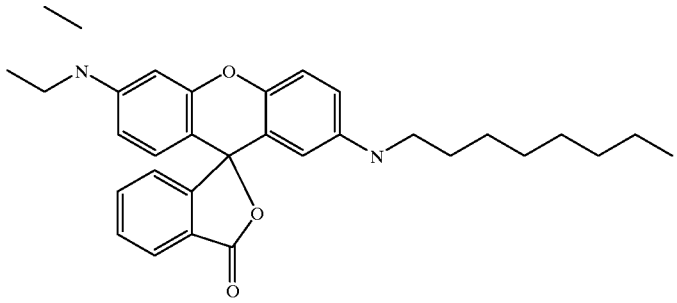

B) 6'-(diethylamino)-2'-(1,1-dimethylethyl)-spiro[isobenzofuran-1(3H),9-[9H]xanthen]-3-one, (B)

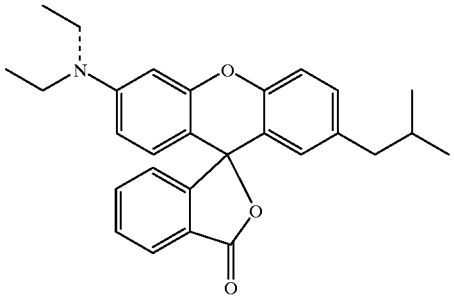

C) 6'-(dibutylamino)-3'-methyl-2'-(phenylamino)-spiro[isobenzofuran-1(3H),9-[9H]xanthen]-3-one, (C)

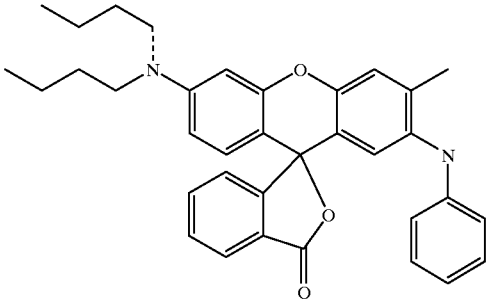

(D) spiro-[isobenzofuran-1(3H),9-(9H)xanthen]-3-one,2'-bisphenylmethyl), (bis(phenylmethyl)amino)-6'-(diethylamino), (D)

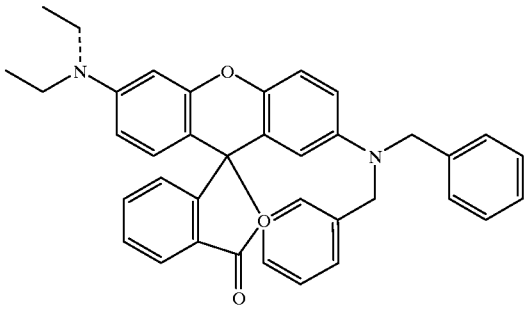

(E) spiro-[isobenzofuran-1(3H),9-(9H)xanthen]-3-one,2'-carboxylic acid, 6'-diethylamino)-3-oxo-, ethyl ester, (E)

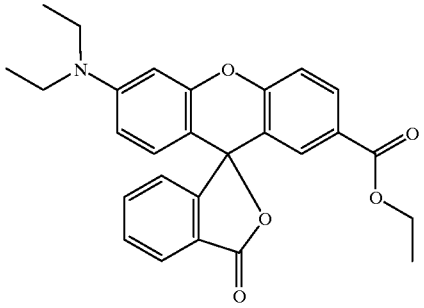

(F) 6'-diethylamino-2'-[2,4-dimethylphenyl)amino]-3'-methyl-spiro[isobenzofuran-1(3H),9-(9H)xanthen]-3-one, (F)

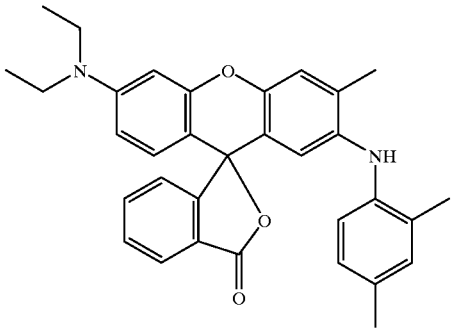

(G) 6'-(ethyl-(3-methylbutyl)amino-2'-phenylamino-3'-methyl-spiro[isobenzofuran-1(3H),9'-(9H)xanthen]-3-one, (G)

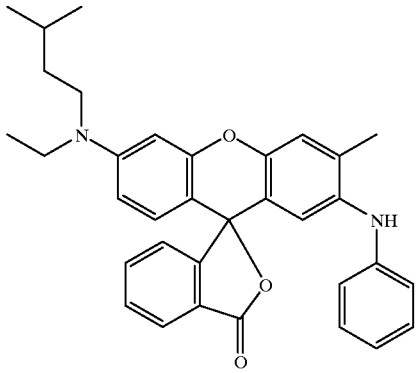

The above-identified colour-formers were used in the combinations as set out in the following table to make up 14 different Examples:

| COLOUR FORMER | Example No. 1 | 2 | 3 | 4 | 5 | 6 | 7 |
|---|---|---|---|---|---|---|---|
| A | 65 | 65 | 65 | 25 | — | 65 | 65 |
| B | 15 | 7.5 | 7.5 | — | 15 | 7.5 | 7.5 |
| C | 20 | — | 13.75 | 60 | 60 | — | 13.75 |
| D | — | — | — | — | 25 | — | — |
| E | — | — | — | 15 | — | — | — |
| F | — | — | — | — | — | 27.5 | 13.75 |
| G | — | 27.5 | 13.75 | — | — | — | — |
| total | 100 | 100 | 100 | 100 | 100 | 100 | 100 |

| COLOUR FORMER | Example No. 8 | 9 | 10 | 11 | 12 | 13 | 14 |
|---|---|---|---|---|---|---|---|
| A | — | — | — | — | — | — | — |
| B | 15 | 15 | — | — | — | — | — |
| C | 30 | 30 | 30 | 30 | 60 | 30 | 30 |
| D | 25 | 25 | 25 | 25 | 25 | 25 | 25 |
| E | — | — | 15 | 15 | 15 | 15 | 15 |
| F | — | 30 | — | 30 | — | — | 30 |
| G | 30 | — | 30 | — | — | 30 | — |
| total | 100 | 100 | 100 | 100 | 100 | 100 | 100 |

In each case the specified composition of colour-formers was used to form an internal phase solution by mixing them in the proportions indicated in the above table such that an intense black print is subsequently obtained in use. The mixture of chromogenic materials was dispersed into deodorised refined rape seed oil and the temperature raised to 115° C. In order to ensure total dissolution the temperature was held for 30 minutes. The concentration of the chromogenic materials dispersed in rape seed oil was 6.9%.

The dissolution characteristics of the solvent system during the temperature rise and fall were determined by turbidimetry with the following results:

| Temperature ° C. | Dissolution % |
|---|---|
| 65 | 19 |
| 81 | 41 |
| 99 | 87 |
| 115 | 98 |
| 56 | 97 |
| 35 | 96 |
| 27 | 97 |

showing that substantially complete solution was attained and maintained.

The above solution was then allowed to cool at 60° C. and maintained at this temperature.

The internal phase solutions in accordance with each Example were then emulsified in a mixture of gelatine and carboxymethyl cellulose (CMC) at 55±5° C. to a mean capsule size of approximately 5 mm as measured using a Coulter Counter, each emulsion was diluted by the addition of soft water and the pH adjusted by the addition of 20% sodium hydroxide to a pH value 9.0–9.5. Thereafter dilute acetic acid was added to reduce the pH of the gelatine below the isoelectric point resulting in a change in charge of the gelatine and, on further acidification, the formation of liquid coacervates resulted from the phase separation and interrelation with the negatively charged CMC in conventional manner.

Further acidification caused the liquid coacervates to be attracted to the nucleus or core material (i.e. the internal phase solution produced initially as described above) and coalesce to form a liquid wall, and when further acidification resulted in the desired degree of clustering acidification was stopped.

The dispersions were then cooled at 8° C.–10° C. in order to gel the liquid walls of the coacervates. At 8° C.–10° C. the liquid walls were cross linked by the addition of an aldehyde (e.g. formaldehyde) and followed by an increase in pH by the further addition of 20% sodium hydroxide to pH 9.0.

The cross linked dispersions were finally returned to ambient temperature and allowed to homogenise and condition (e.g. age) for a predetermined period (1–3 hours).

After ageing the resultant capsule dispersion was blended with a suitable binder (e.g. starch or starch/P.V.A. mixture) and a suitable "stilt buffer" (e.g. cellulose floc or calibrated wheat starch) to produce a mixture suitable for coating onto a sheet material by conventional means.

The pressure-sensitive record materials thus produced have been found to have a good shelf life and to provide intense colour-forming.

Laboratory scale encapsulations have also been made and tested with similar good results, utilising other vegetable oils such as sunflower oil and animal oils such as cod liver oil and beef dripping, and various mixtures of such oils.

Whilst in the above-described Examples the colour-formers used are all fluoran derivatives and the solvents are 100% animal or vegetable oil, it is to be understood that additional non-fluoran colour-formers may be included at up to about 10% of the colour-former formulation, and that other non-animal or vegetable oil solvents may be included in the solvent at up to about 20% of the solvent if required, although the use of 100% fluoran colour-formers and 100% animal or vegetable oils as solvents is entirely satisfactory.

I claim:

1. A pressure sensitive record material comprising a base sheet coated with a rupturable material confining droplets of an internal phase, wherein the rupturable material comprises one or more colour-formers of which at least 90% are selected from the following monoamino and/or diamino fluoran derivatives:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran-1(3H),9-[9H]xanthen]-3-one, wherein the colour-formers are dissolved in a solvent comprising substantially 100% of one or more vegetable and/or animal oils, alone or in combination, selected from the group consisting of a rape seed oil, cotton seed oil, olive oil, corn oil, wheat oil, soy oil, castor oil, thistle oil, ground nut oil, sunflower oil, grape seed oil, sesame oil, whale oil, sperm oil, fish oil and cod liver oil.

2. A material according to claim 1 wherein said solvent comprises 100% of one or more vegetable and/or animal oils.

3. A pressure sensitive record material comprising a base sheet coated with a rupturable material confining droplets of an internal phase, wherein the rupturable material comprises one or more colour-formers of which at least 90% are selected from the following monoamino and/or diamino fluoran derivatives:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran- 1(3H),9'-[9H]xanthen]-3-one, spiro-[isobenzofuran-1(3H),9-(9H)xanthen]-3-one,2'-[bis (phenylmethyl)amino]-6'-(diethylamino), spiro-[isobenzofuran-1(3H),9-(9H)xanthen]-3-one,2'-carboxylic acid, 6'-(diethylamino)-3-oxo, ethyl ester, 6'-diethylamino-2'-[2,4-dimethylphenyl)amino]-3'-methyl-spiro[isobenzofuran-1(3H),9-[9H]xanthen]-3-one, 6'-(ethyl-(3-methylbutyl)amino-2'-phenylamino-3'-methyl-spiro[isobenzofuran-1(3H),9'-[9H]xanthen]-3-one, wherein the colour-formers are dissolved in a solvent comprising substantially 100% of one or more vegetable and/or animal oils, alone or in combination, selected from the group consisting of a rape seed oil, cotton seed oil, olive oil, corn oil, wheat oil, soy oil, castor oil, thistle oil, ground nut oil, sunflower oil, grape seed oil, sesame oil, whale oil, sperm oil, fish oil, and cod liver oil.

4. A pressure-sensitive record material comprising a base sheet coated with a rupturable material confining droplets of an internal phase, wherein the rupturable material comprises one or more colour-formers of which at least 90% comprise the following monoamino and/or diamino fluoran derivatives:

2'-(octylamino)-6'-(diethylamino)fluoran,

6'-(diethylamino)-2'-(1,1-dimethylethyl)fluoran, and

6'-(dibutylamino)-3'-methyl-2'-(phenylamino)-spiro [isobenzofuran-1(3H),9-[9H]xanthen]-3-one, and wherein the colour-formers are dissolved in a solvent consisting of 100% of one or more vegetable and/or animal oils, alone or in combination, and selected from the group consisting of rape seed oil, cotton seed oil, olive oil, corn oil, wheat oil, soy oil, castor oil, thistle oil, ground nut oil, sunflower oil, grape seed oil, sesame oil, whale oil, sperm oil, fish oil, and cod liver oil.

5. A method of manufacturing a pressure-sensitive record material comprising the steps of:

1) coating a base sheet with a rupturable material confining droplets of a solution of one or more colour-formers characterised in that at least 90% of said colour formers are selected from the following monoamino and/or diamino fluoran derivatives:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran-1(3H),9-[9H]xanthen]-3-one, 2) dissolving said colour-formers in a solvent comprising 80% to 100% of an animal or vegetable oil the step of dissolving said colour-formers being carried at a temperature above 100° C.

6. A method according to claim 1 wherein dissolution of said colour-formers is carried out at a temperature of up to 135° C.

7. A method according to claim 1 wherein the solvent comprises 100% of one or more vegetable and/or animal oils.

8. A method of manufacturing a pressure-sensitive record material comprising the steps of:

1) preparing a solution consisting essentially of one or more colour-formers dissolved in a solvent, characterised in that at least 90% of said colour-formers comprise one or more of the following amino fluorans:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran-1(3H),

9-[9H]xanthen]-3-one, spiro-[isobenzofuran-1(3H),9-(9H)xanthen]-3-one,2'-[bis(phenylmethyl)amino]-6'-(diethylamino), spiro-[isobenzofuran-1(3H),9-(9H)xanthen]-3-one,2'-carboxylic acid, 6'-(diethylamino)-3-oxo-, ethyl ester, 6'-diethylamino-2'-[2,4-dimethylphenyl)amino]-3'-methyl-spiro[isobenzofuran-1(3H),9-[9H]xanthen]-3-one, 6'-(ethyl-(3-methylbutyl)amino-2'-phenylamino-3'-methyl-spiro[isobenzofuran-1(3H),9'-[9H]xanthen]-3-one, and in that the solvent consists of 100% of one or more animal and/or vegetable oils, by dissolving said colour-formers in said solvent at a temperature above 100° C. and 2) coating a base sheet with a rupturable material confining droplets of said solution.

9. A method of manufacturing a pressure-sensitive record material comprising the steps of:

1) coating a base sheet with a rupturable material confining droplets of a solution of one or more colour-formers characterised in that at least 90% of said colour-formers are selected from the following monoamino and/or diamino fluoran derivatives:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran-1(3H),9-[9H]xanthen]-3-one, spiro-[isobenzofuran-1(3H),9-(9H)xanthen]-3-one,2'-[bis(phenylmethyl)amino]-6'-(diethylamino), spiro-[isobenzofuran-1(3H),9-(9H)xanthen]-3-one,2'-carboxylic acid, 6'-(diethylamino)-3-oxo, ethyl ester, 6'-diethylamino-2'-[2,4-dimethylphenyl)amino]-3'-methyl-spiro[isobenzofuran-1(3H),9-[9H]xanthen]-3-one, 6'-(ethyl-(3-methylbutyl)amino-2'-phenylamino-3'-methyl-spiro[isobenzofuran-1(3H),9'-[9H]xanthen]-3-one.

10. A method of manufacturing a pressure-sensitive record material comprising the steps of:

1) preparing a solution consisting essentially of one or more colour-formers dissolved in a solvent, characterised in that at least 90% of said colour-formers comprise one or more of the following monoamino and/or diamino fluoran derivatives:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran-1(3H),9-[9H]xanthen]-3-one, and in that the solvent consists of 100% of one or more animal and/or vegetable oils, by dissolving said colour-formers in said solvent at a temperature above 100° C. and, 2) coating a base sheet with a rupturable material confining droplets of said solution.

11. A composition suitable for use as an internal phase of a coating of rupturable material on a base sheet to form a pressure-sensitive record material, the composition comprising one or more colour-formers of which at least 90% comprise one or more of the following amino fluorans:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran-1(3H),9-[9H]xanthen]-3-one, spiro-[isobenzofuran-1(3H),9-(9H)xanthen]-3-one,2'-[bis(phenylmethyl)amino]-6'-(diethylamino), spiro-[isobenzofuran-1(3H),9-(9H)xanthen]-3-one,2'-carboxylic acid, 6'-(diethylamino)-3-oxo-, ethyl ester, 6'-diethylamino-2'-[2,4-dimethylphenyl)amino]-3'-methyl -spiro[isobenzofuran-1(3H),9-[9H]xanthen]-3-one, 6'-(ethyl-(3-methylbutyl)amino-2'-phenylamino-3'-methyl-spiro[isobenzofuran-1(3H),9'-[9H]xanthen]-3-one.

12. A composition suitable for use as a rupturable internal phase coating on a base sheet to form a pressure-sensitive record material, the composition comprising one or more colour-formers of which at least 90% are selected from the following monoamino and/or diamino fluoran derivatives:

2'-(octylamino)-6'-(diethylamino)fluoran,

6'-(diethylamino)-2'-(1,1-dimethylethyl)fluoran,

6'-(dibutylamino)-3'-methyl-2'-(phenylamino)-spiro [isobenzofuran-1(3H),9-[9H]xanthen]-3-one, spiro-[isobenzofuran-1(3H),9-(9H)xanthen]-3-one,2'-[bis (phenylmethyl)amino]-6'-(diethylamino), spiro-[isobenzofuran-1(3H),9-(9H)xanthen]-3-one,2'-carboxylic acid, 6'-(diethylamino)-3-oxo-, ethyl ester, 6'-diethylamino-2'-[2,4-dimethylphenyl)amino]-3'-methyl-spiro[isobenzofuran-1(3H),9-[9H]xanthen]-3-one, 6'-(ethyl-(3-methylbutyl)amino-2'-phenylamino-3'-methyl-spiro[isobenzofuran-1(3H),9'-[9H]xanthen]-3-one, wherein the colour-formers are dissolved in a solvent comprising substantially 100% of one or more vegetable and/or animal oils, alone or in combination, selected from the group consisting of rape seed oil, cotton seed oil, olive oil, corn oil, wheat oil, soy oil, castor oil, thistle oil, ground nut oil, sunflower oil, grape seed oil, sesame oil, whale oil, sperm oil, fish oil, and cod liver oil.

13. A composition suitable for use as an internal phase of a coating of rupturable material on a base sheet to form a pressure-sensitive record material, the composition comprising one or more colour-formers of which at least 90% comprise one or more of the following monoamino and/or diamino fluoran derivatives:

2'-(octylamino)-6'-(diethylamino)fluoran,

6'-(diethylamino)-2'-(1,1-dimethylethyl)fluoran, and

6'-(dibutylamino)-3'-methyl-2'-(phenylamino)-spiro [isobenzofuran-1(3H),9-[9H]xanthen]-3-one dissolved in a solvent consisting of 100% of one or more vegetable and/or animal oils, alone or in combination, and selected from the group consisting of rape seed oil, cotton seed oil, olive oil, corn oil, wheat oil, soy oil, castor oil, thistle oil, ground nut oil, sunflower oil, grape seed oil, sesame oil, whale oil, sperm oil, fish oil, and cod liver oil.

* * * * *